US005608370A

United States Patent [19]

Jang

[11] Patent Number: 5,608,370

[45] Date of Patent: Mar. 4, 1997

[54] ROTARY TRANSFORMER AND METHOD FOR FABRICATING THE SAME

[75] Inventor: Woo S. Jang, Seoul, Rep. of Korea

[73] Assignee: LG Electronics Inc., Seoul, Rep. of Korea

[21] Appl. No.: 434,413

[22] Filed: May 3, 1995

[30] Foreign Application Priority Data

May 3, 1994 [KR] Rep. of Korea ..... 9721/1994

[51] Int. Cl.[6] ..... H01F 15/04

[52] U.S. Cl. ..... 336/120; 336/84 C; 336/122; 336/110

[58] Field of Search ..... 336/120, 110, 336/122, 84 C; 310/114, 162, 176, 268

[56] References Cited

U.S. PATENT DOCUMENTS 5,347,256 9/1994 Yumiki et al. .

*Primary Examiner*—Michael L. Gellner
*Assistant Examiner*—G. R. Lord
*Attorney, Agent, or Firm*—Fish & Richardson, P.C.

[57] ABSTRACT

A rotary transformer includes a rotor core formed by stacking channel parts to form a required number of channels. Each channel part is formed by stacking two kinds of annular magnetic rings so that two rings having the same outside and inside diameters are placed at both sides of a ring having the same inside diameter as the two rings but a greater outside diameter than the two rings. A stator core is also formed by stacking channel parts to form the required number of channels. The channel part is formed by stacking two kinds of annular magnetic rings so that two rings having the same outside and inside diameters are placed on both sides of a ring having the same inside diameter with the two rings but smaller outside diameter than the two rings. A thin layer of glass can be used to bond the rings of the stator or rotor together.

10 Claims, 6 Drawing Sheets

ROTOR CORE

STATOR CORE

ROTOR CORE

STATOR CORE (ROTOR CORE)

(STATOR CORE)

ROTARY TRANSFORMER AND METHOD FOR FABRICATING THE SAME

BACKGROUND OF THE INVENTION

This invention relates to a rotary transformer, and more particularly to a rotary transformer which can solve the problems associated with rotary transformers having channel grooves machined therein, which typically experience a high percentage of defective parts and low dimensional precision.

As shown in FIG. 1, a rotary transformer used for transmitting signals received from heads to a stator side circuit in an apparatus having rotating type magnetic heads, such as a VCR, camcorder, or digital audio tape recorder, includes a stator side core and a rotor side core, each of which cores has channel grooves 3 corresponding to the number of channels and short ring grooves 4 each for inserting a short ring.

The rotor 2 and the stator maintain a very small aperture on the order of a few tens of μm between them, and the rotor 2 reads signals from the heads while being rotated, and transmits the signals to the stator 1.

Therefore, the dimensions of the rotor 2 and the stator 1 should be very precise, otherwise picture quality can be degraded due to noise caused in the course of the signal transmission and due to fluctuation in inductance.

A method for forming the rotary transformer having the foregoing structure is as follows.

First, inside and outside diameters of the cylindrical ferrite powder sintered bodies shown in FIGS. 2*a* and 2*b* are formed with a powder molding method so as to have about 1 mm machining allowance taking into account of many steps of machining.

Outside surfaces of the formed cylindrical sintered bodies are primarily ground with a centerless grinder, and the inside surfaces are rough ground with an internal grinder taking the ground outside surfaces as reference surfaces. The outside and inside surfaces are finally ground with a special purpose grinder.

By machining the channel grooves 3 and the short ring grooves 4 in the inside and outside surfaces of the machined cylindrical ferrite sintered bodies according to a number of required channels, the cores shown in FIGS. 3*a* and 3*b* are completed.

However, since the rotary transformer having the foregoing structure is formed by machining the channel grooves and short ring grooves after grinding surfaces of the cylindrical ferrite sintered bodies, it has problems in that it has a high percentage of defective and low preciseness of the dimension of the channel grooves due to the machining.

Further the rotary transformer has problems in that the productivity has been low since the core has been machined one by one in each machining, and the machining has been difficult in case diameter of the core is very small in the order of a few millimeters.

SUMMARY OF THE INVENTION

The object of this invention designed to solve the foregoing problems is to provide a rotary transformer, including two cores each having two different sized annular magnetic rings which are stacked and bonded together.

The object of this invention can be achieved by providing a rotary transformer including a rotor and a stator having any combination of one pair of cores depending on the cases, of which one core formed by stacking channel parts as much as a required number of channels, which channel part is formed by stacking two kinds of annular magnetic rings so that two rings having the same outside and inside diameters are placed at both sides of a ring having the same inside diameter with the two rings but greater outside diameter than the two rings, and the other core formed by stacking channel parts as much as the required number of channels, which channel part is formed by stacking two kinds of annular magnetic rings so that two rings having the same outside and inside diameters are placed on both sides of a ring having the same inside diameter with the two rings but smaller outside diameter than the two rings, whereby channel grooves are formed by bonding the stacked different diametered magnetic annular rings, which bonding between the magnetic annular rings are done with glass having low melting point, a thickness of the low melting point glass between adjacent same diametered rings is 5 to 100 μm depending on a size of the rings and a thickness of the low melting point glass between adjacent different diametered rings is 100 to 500 Å depending on a size of the rings.

These and other objects and features of this invention can be achieved by providing a method for fabricating a rotary transformer, including processes for cutting machined cylindrical magnetic cores into annular rings having predetermined thickness of T1 and T2, depositing low melting point glass on one or both sides of each of the annular rings, stacking the glass film deposited annular rings so that channel grooves can be formed on outside or inside thereof, and bonding the stacked rings by heating and cooling the stacked rings for a predetermined period of time into stacked magnetic cores.

DETAILED DESCRIPTION OF THE PREFERRED EMBODIMENTS

This invention is to be explained hereinafter, referring to the attached drawings.

In order to improve the high percentage of defective and unprecise dimensions caused by machining of channel grooves for winding coils therein in fabricating rotary transformers, a rotary transformer of this invention is formed as follows.

Figure 4A:
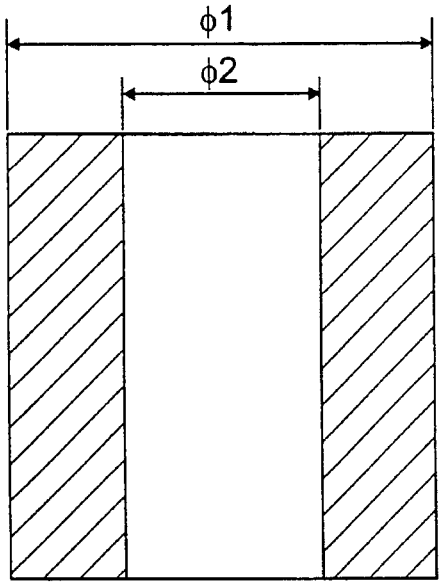
FIGS. 4*a* and 4*b* are sections of cylindrical ferrite sintered bodies for a rotary transformer core in accordance with this invention.
Figure 4B:
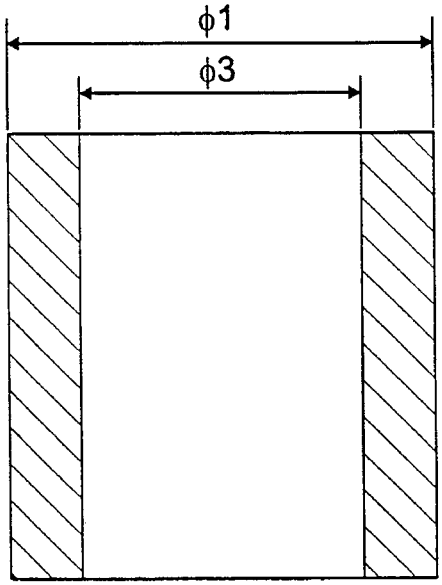
Figure 5A:
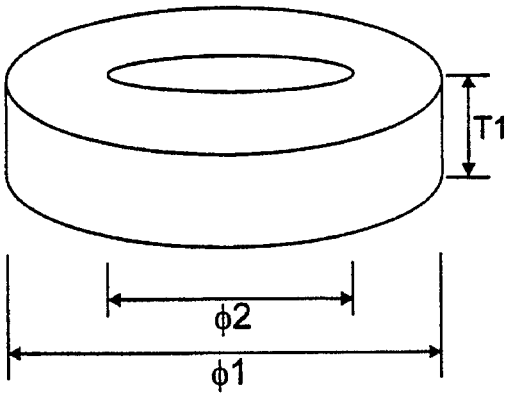
FIGS. 5*a* and 5*b* are perspective views of ferrite annular rings each obtained by cutting the ferrite sintered bodies of FIGS. 4*a* and 4*b* to a predetermined thickness, respectively.
Figure 5B:
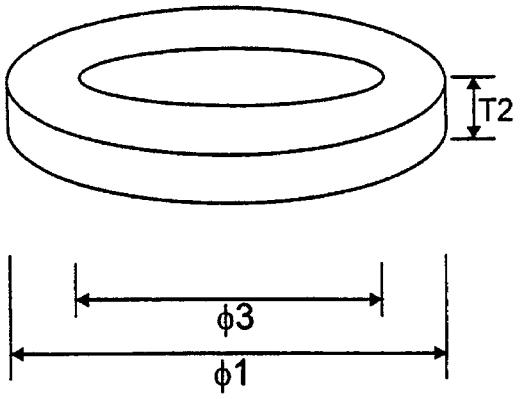

First, for forming a rotor core, one pair of cylindrical ferrite sintered bodies are formed in two sizes. Both the inside and outside surfaces of each cylinder are ground so that the outside diameters are $\phi 1$ respectively, the same to each other, and the inside diameters are $\phi 2$ and $\phi 3$, different from each other, as shown in FIGS. 4*a* and 4*b*, which are cut to obtain many annular rings each having a thickness of T1 and T2, as shown in FIGS. 5*a* and 5*b*, respectively.

Glass films are deposited on one or both surfaces of each of the rings cut to a predetermined thickness with a sputtering method using glass having a melting point of 400 to 500 deg. C. and a thermal expansion coefficient similar to that of ferrite.

Figure 6A:
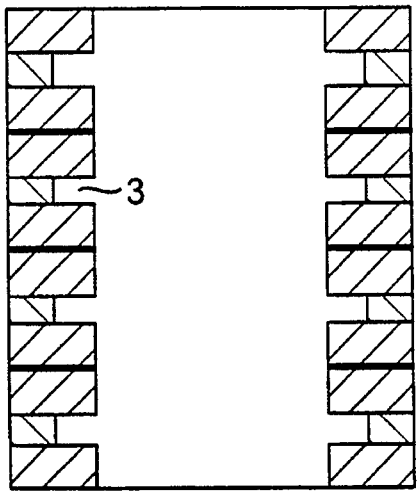
FIGS. 6*a* and 6*b* are sections of one pair of rotary transformer cores formed by stacking and bonding the annular rings of FIGS. 5*a* and 5*b* together.

As shown in FIG. 6*a*, the annular rings with deposited glass on one or both surfaces thereof are stacked to form as many channels as required, and fixed to be kept in position.

Figure 6B:
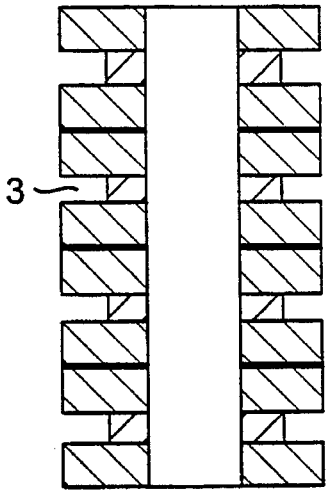

As shown in FIG. 6*b*, the stator core is formed by stacking and fixing the annular rings having the same inside diameters, but different outside diameters, and glass is deposited using the same process explained above.

In this time, the core shown in FIG. 6*a* can be a stator core and the core shown in FIG. 6*b* can be a rotor core depending on the cases.

By placing the rotor core and stator core each made up by annular rings in an electric furnace and heating with a temperature program suitable for the sputtered glass between the annular rings to melt for bonding the rings, a completed one pair of rotary transformer cores can be obtained.

The glass used in this case should be of low melting point for shortening the thermal bonding process and reducing the thermal shock put on the ferrite.

When the thickness of the glass film used for bonding the annular rings in the foregoing process is below 100 Å, a bonding force between the annular rings becomes weaker. When the thickness is over 500 Å, although the bonding force becomes stronger, the distance between the rings becomes greater, which causes a greater amount of magnetic flux leakage from the magnetic path. The thickness between these two volumes should be appropriate for preventing degradation of the rotary transformer.

Figure 1:
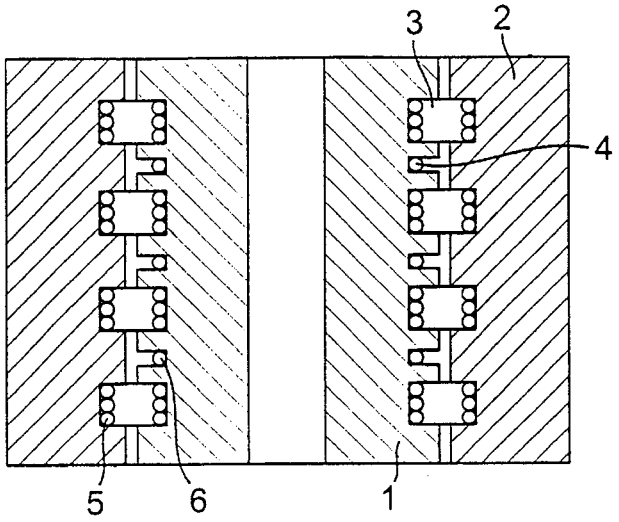
FIG. 1 PRIOR ART
FIG. 1 is a section of a conventional rotary transformer.
Figure 2A:
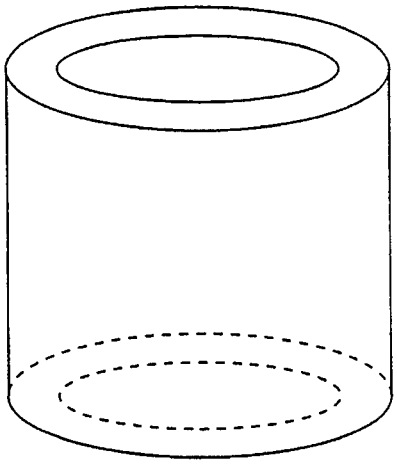
FIG. 2a PRIOR ART
FIGS. 2*a* and 2*b* are perspective views of cylindrical ferrite sintered bodies for the conventional rotary transformer before machining channel grooves.
Figure 2B:
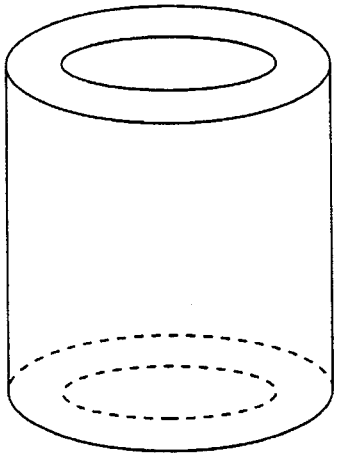
FIG. 2b PRIOR ART
Figure 3A:
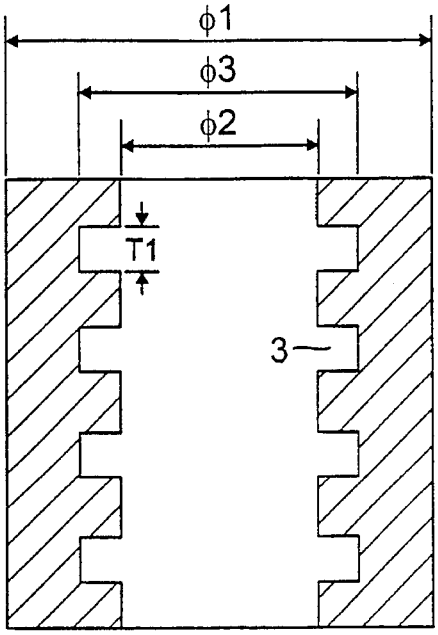
FIG. 3a PRIOR ART
FIGS. 3*a* and 3*b* are sections of one pair of conventional rotary transformer cores.
Figure 3B:
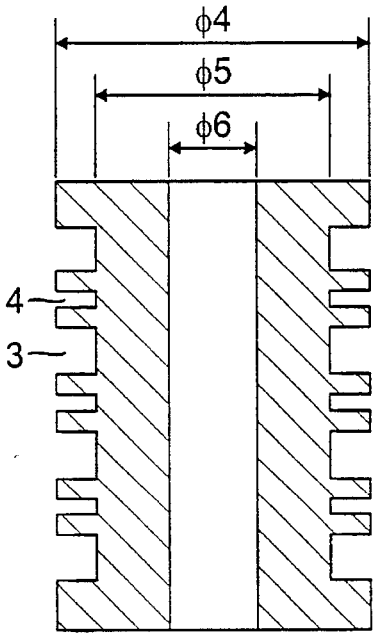
FIG. 3b PRIOR ART

The reason why the rotary transformer core in accordance with this invention has not been provided with the short ring grooves that has been provided between each of the channels of the stator core for reducing signal interference between channels in the conventional art shown in FIG. 1 is that the short ring effect can be achieved by eliminating the signal interference between the channels with the distance between the channels of the stator core and the rotor core, where the glass has been melted for bonding between the channels.

To make this short ring effect greater, the thickness of the glass film should be thicker.

The glass film thickness between the channels is adjusted between a few μm and a few hundreds μm according to size of the core.

Shown in FIGS. 7*a* to 9 are one embodiment of a rotary transformer in accordance with this invention, wherein, in case of the rotor core, a cylindrical sintered body with 10.50 mm outside diameter, inside diameter 6.5 mm, and 20 mm length, and a cylindrical sintered body with 10.50 mm outside diameter, inside diameter 7.5 mm, and 20 mm length are formed by forming Ni-Cu-Zn ferrite powder into the cylindrical bodies with proper molds and sintering them.

Figure 7A:
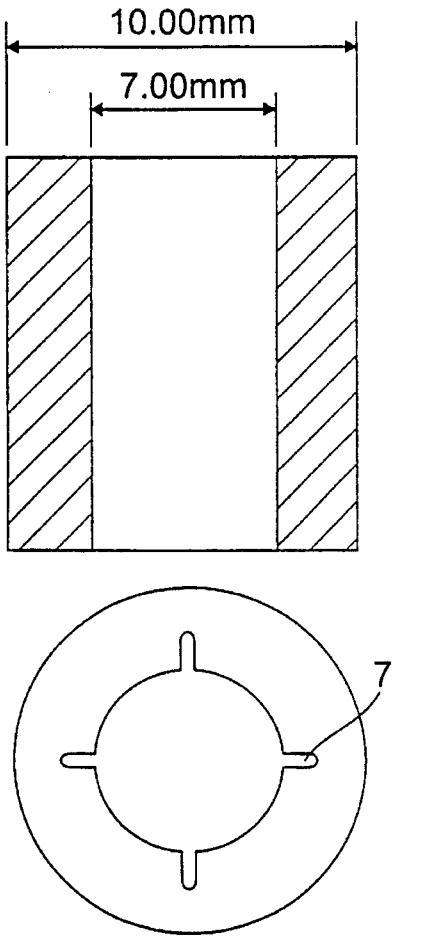
FIGS. 7*a* and 7*b* are sections of one embodiment of cylindrical ferrite sintered bodies used for forming a rotor or a stator core in accordance with this invention.
Figure 7B:
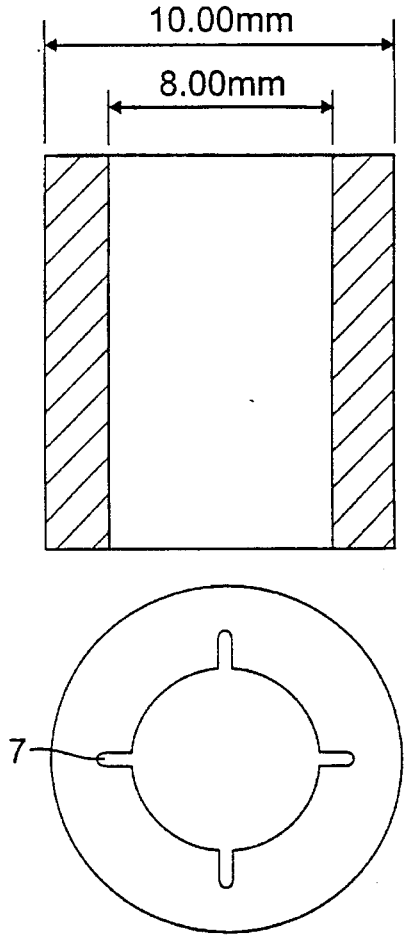

As shown in FIG. 7*a* and 7*b*, the cylinders are ground into cylinders having an outside diameter 10.00 mm, inside diameter 7.00 mm, and an outside diameter 10.00 mm, inside diameter 8.00 mm, respectively.

Figure 8A:
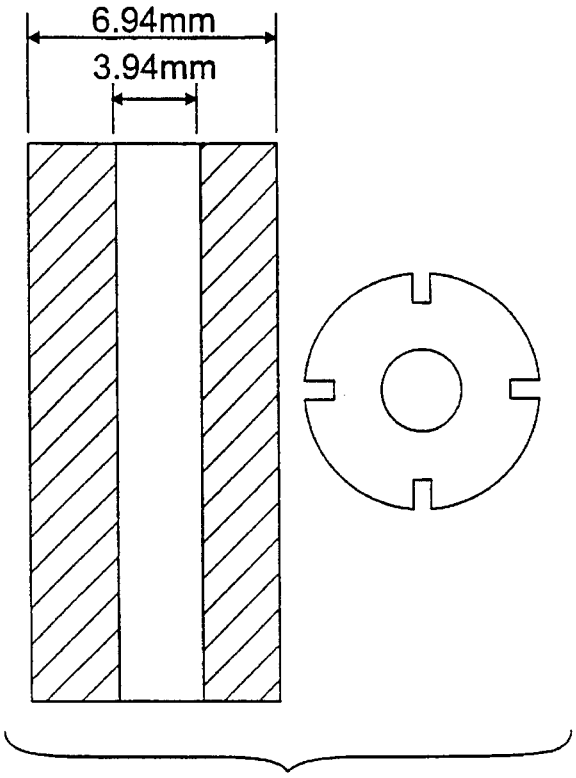
FIGS. 8*a* and 8*b* are sections of one embodiment of cylindrical ferrite sintered bodies used for forming a stator or rotor core in accordance with this invention.
Figure 8B:
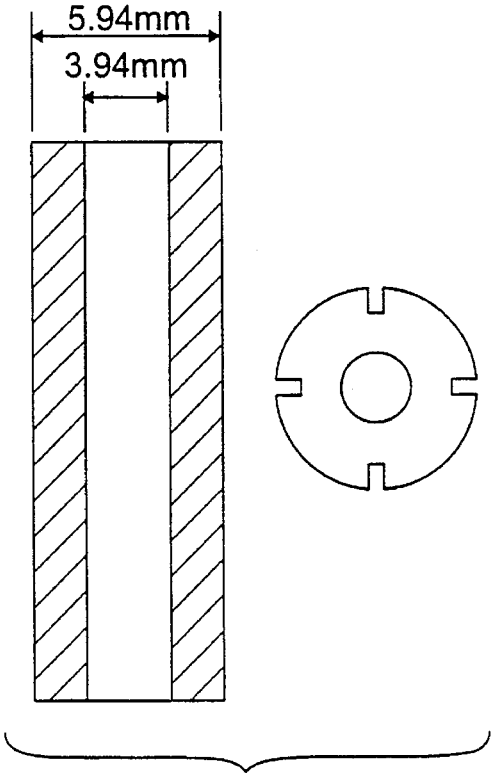

For forming the stator core, with a method similar to the case of the rotor core formation, the cylindrical sintered bodies are machined into cylinders having, as shown in FIGS. 8*a* and 8*b*, an outside diameter 6.94 mm, inside diameter 3.94 mm, and an outside diameter 5.94 mm, inside diameter 3.94 mm, respectively.

Herein, coil leading grooves 7 in each of the sintered bodies are formed by the molds for four channels.

In cutting the sintered cylinders, each ground into a predetermined size, the sintered bodies of FIGS. 7*a* and 8*a* are cut into annular rings with a thickness of 0.60 mm, and the sintered bodies of FIGS. 7*b* and 8*b* are cut into annular rings with a thickness of 0.60 mm.

Then, each of these rings is subjected to deposition of glass with a sputtering method to deposit 50 Å of glass film per minute for 6 minutes to amount to a thickness of 300 Å on one side thereof using glass having a melting point of about 450 deg. C., and a facing surface of each of the annular rings between channels is deposited of glass with sputtering to a thickness of 10 μm.

Figure 9:
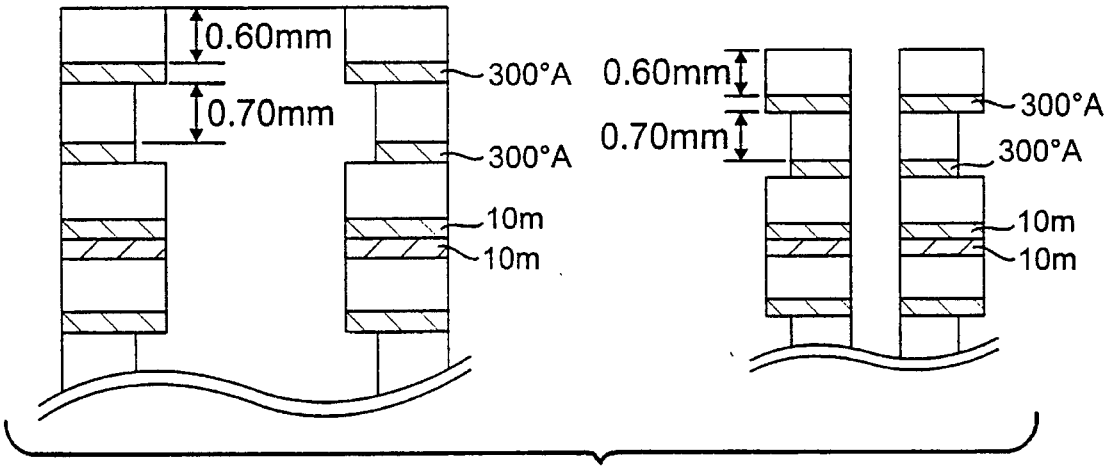
FIG. 9 shows one embodiment of the stacking in accordance with this invention.
Figure 10:
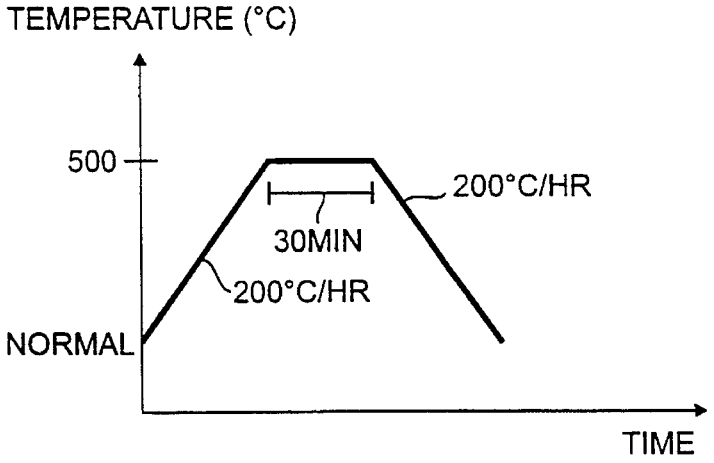
FIG. 10 is a graph showing temperature changes vs. time for bonding stacked cores in accordance with one embodiment of this invention.

As shown in FIG. 9, the annular rings each having the glass film deposited thereon are stacked and fixed in position, are placed in an electric furnace, and are subjected to heating up to 500 deg. C. with the temperature raised by 200 deg. C. per hour, maintaining 500 deg. C. for 30 min., and cooling down with the temperature lowered by 200 deg. C. per hour. This causes the annular rings to be bonded with glass, and completes formation of the rotary transformer cores.

As has been explained, this invention can provide a rotary transformer which has no defects due to chipping caused by machining of the channel grooves in forming the conventional rotary transformer, and can improve precision of the channel dimension.

And, since the short ring effect can be achieved without providing the short rings, excluding the process for winding the short rings, it has an advantage of shortening the process.

Especially, since the lower size limit of the core of the rotary transformer available from this invention is very small, in case there is a requirement for making the apparatus compact, like a camcorder, the core size can be reduced to below 5 mm in diameter.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A rotary transformer comprising two cores each comprising one or more channel parts, each channel part having a coil groove constructed of two different sized annular magnetic rings which are stacked and bonded together to form each channel part and coil groove.

2. The rotary transformer as claimed in claim 1, wherein the rotary transformer includes a rotor core constructed by stacking two or more channel parts to form a required number of channels, at least one of said channel parts having a coil groove formed by stacking two different sizes of annular magnetic rings so that two rings having the same outside and inside diameters are placed on both sides of a ring having the same inside diameter with the two rings but a greater outside diameter than the two rings, and a stator core constructed by stacking two or more channel parts to form the required number of channels, at least one of said channel parts having a coil groove formed by stacking two different sizes of annular magnetic rings so that two rings having the same outside and inside diameters are placed at both sides of a ring having the same inside diameter with the two rings but a smaller outside diameter than the two rings.

3. The rotary transformer as claimed in claim 2, wherein there are bonding layers between the annular rings formed of glass having a low melting point for eliminating signal interference between channels.

4. The rotary transformer as claimed in claim 2, wherein a low melting point glass is deposited between adjacent channel part annular magnetic rings having the same inside and outside diameters to a thickness of 5 to 100 μm depending on the size of the core.

5. The rotary transformer as claimed in claim 1, wherein the rotary transformer includes a stator core constructed by stacking two or more channel parts to form a required number of channels, at lest one of said channel parts having a coil groove formed by stacking the two different sizes of annular magnetic rings so that two rings having the same outside and inside diameters are placed on both sides of a ring having the same inside diameter with the two rings but a greater outside diameter than the two rings, and a rotor core constructed by stacking two or more channel parts to form the required number of channels, at least one of said channel parts having a cool grove formed by stacking two different sizes of annular magnetic rings so that two rings having the same outside and inside diameters are placed on both sides of a ring having the same inside diameter with the two rings but a smaller outside diameter than the two rings.

6. The rotary transformer as claimed in claim 5, wherein a low melting point glass is deposited between adjacent channel part annular magnetic rings having the same inside and outside diameters to a thickness of 5 to 100 μm depending on the size of the core.

7. The rotary transformer as claimed in claim 5, wherein a low melting point glass is deposited between adjacent channel part annular magnetic rings having different inside or outside diameters to a thickness of 100 to 500 Å depending on the size of the core.

8. A method for fabricating a rotary transformer comprising the steps of:

cutting different diameter machined cylindrical magnetic cores into annular rings having predetermined thicknesses of T1 and T2;

depositing low melting point glass film on one or both sides of each of the annular rings;

stacking the glass film deposited annular rings so that one or more channel grooves are formed in an outside or an inside of a stack of rings; and, bonding the stacked rings by heating and cooling the stacked rings for a predetermined period of time to form a stacked magnetic core.

9. A rotary transformer comprising:

a rotor comprising a plurality of first channels, each first channel comprising a lamination of annular magnetic rings having different inner diameters; and a stator comprising a plurality of second channels, having different outer diameters, each first channel being located in correspondence with each corresponding second channel.

10. A rotary transformer comprising:

a stator comprising a plurality of second channels each first channel comprising a lamination of annular magnetic rings having different inner diameters; and a rotor comprising a plurality of second channels, each second channel comprising a lamination of annular magnetic rings having different outer diameters, each first channel being located in correspondence with each corresponding second channel.

* * * * *